US008251034B2

(12) United States Patent
Hashim

(10) Patent No.: US 8,251,034 B2
(45) Date of Patent: Aug. 28, 2012

(54) CONTROL OF A PRE-SPUN STARTER

(75) Inventor: Tariq O. Hashim, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 224 days.

(21) Appl. No.: 12/638,028

(22) Filed: Dec. 15, 2009

(65) Prior Publication Data

US 2011/0139108 A1 Jun. 16, 2011

(51) Int. Cl.
*F02N 11/00* (2006.01)

(52) U.S. Cl. ..... 123/179.3; 123/179.25; 701/113

(58) Field of Classification Search ..... 123/179.3, 123/179.28, 179.25, 179.4; 73/114.25, 114.26, 73/114.59; 701/110, 113
See application file for complete search history.

(56) References Cited

U.S. PATENT DOCUMENTS 4,022,164 A * 5/1977 Fuchs ..... 123/339.14
6,722,332 B2 * 4/2004 Kojima ..... 123/179.3
2009/0212569 A1 * 8/2009 Bauer ..... 290/47
2011/0168117 A1 * 7/2011 Bolander et al. ..... 123/179.3
2011/0172901 A1 * 7/2011 Okumoto et al. ..... 701/113
2011/0202254 A1 * 8/2011 Ishikawa et al. ..... 701/103

FOREIGN PATENT DOCUMENTS

CN 101445038 A 6/2009
CN 101567655 A 10/2009
JP 2002-70699 * 3/2002
JP 2005-330813 * 12/2005
JP 2010-236533 * 10/2010

* cited by examiner

*Primary Examiner* — Hai Huynh
(74) *Attorney, Agent, or Firm* — Quinn Law Group, PLLC

(57) ABSTRACT

A method is provided for controlling a starting system for an engine of a motor vehicle. The motor vehicle includes a pre-spun starter for selective meshing with and starting of the engine, and a controller for controlling the starting of the engine. The method includes sensing of a rotational speed of the pre-spun starter, and sensing of a rotational speed of the engine. The method additionally includes regulating the rotational speed of the pre-spun starter to substantially synchronize the rotational speed of the pre-spun starter with the rotational speed of the engine. Furthermore, the method includes engaging the pre-spun starter gear with the engine, and applying torque by the pre-spun starter to the engine, such that the engine is started.

18 Claims, 2 Drawing Sheets

CONTROL OF A PRE-SPUN STARTER

TECHNICAL FIELD

The invention relates to control of a pre-spun starter employed for starting an engine of a motor vehicle.

BACKGROUND OF THE INVENTION

In a typical motor vehicle, the vehicle's engine, such as an internal combustion engine, is typically rotated via a starter to cause the engine to begin powering itself. A typical starter includes a pinion gear that is driven by an electric motor, and is pushed out for engagement with a ring gear that is attached to the engine's flywheel or flex-plate, in order to start the engine.

In some applications, a pre-spun starter is employed for such a function. A pre-spun starter is a type of a starter in which rotation of the pinion gear is controlled separately from its engagement with the engine ring gear. Such a starter may be employed in a conventional vehicle having a single powerplant, or in a hybrid vehicle application, that includes both an internal combustion engine and a motor/generator for powering the vehicle.

SUMMARY OF THE INVENTION

A method is provided for controlling a starting system for an engine of a motor vehicle. The motor vehicle includes a pre-spun starter for selective meshing with and starting of the engine, and a controller for controlling the starting of the engine. The method includes sensing of a rotational speed of the pre-spun starter, and sensing of a rotational speed of the engine. The method additionally includes regulating the rotational speed of the pre-spun starter to substantially synchronize the rotational speed of the pre-spun starter with the rotational speed of the engine. Furthermore, the method includes engaging the pre-spun starter gear with the engine, and applying torque by the pre-spun starter to the engine, such that the engine is started.

According to one embodiment of the method, the sensing of the rotational speed of the pre-spun starter is accomplished via one of an optical speed sensor and a magnetic angular speed sensor. The magnetic angular speed sensor may be a Hall effect type.

According to the method, the sensing of the rotational speed of the engine may similarly be accomplished via one of an optical speed sensor and a magnetic angular speed sensor. In such a case, the magnetic angular speed sensor may also be a Hall effect type.

The method may further include determining whether the sensed speeds of the pre-spun starter and of the engine are within a pre-determined speed difference. The regulating of the rotational speed of the pre-spun starter may be accomplished by the controller. The controller may regulate and synchronize the rotational speeds of the pre-spun starter and the engine, if the sensed speeds of the pre-spun starter and of the engine are not within the pre-determined speed difference.

The vehicle employing the method may be a hybrid-electric type having a motor/generator capable of propelling the vehicle, such that the engine is capable of being shut-off when the motor/generator is running.

Additionally, a system is disclosed for controlling a starting of an engine of a motor vehicle, wherein a controller, such as above, is adapted for executing the aforementioned method.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
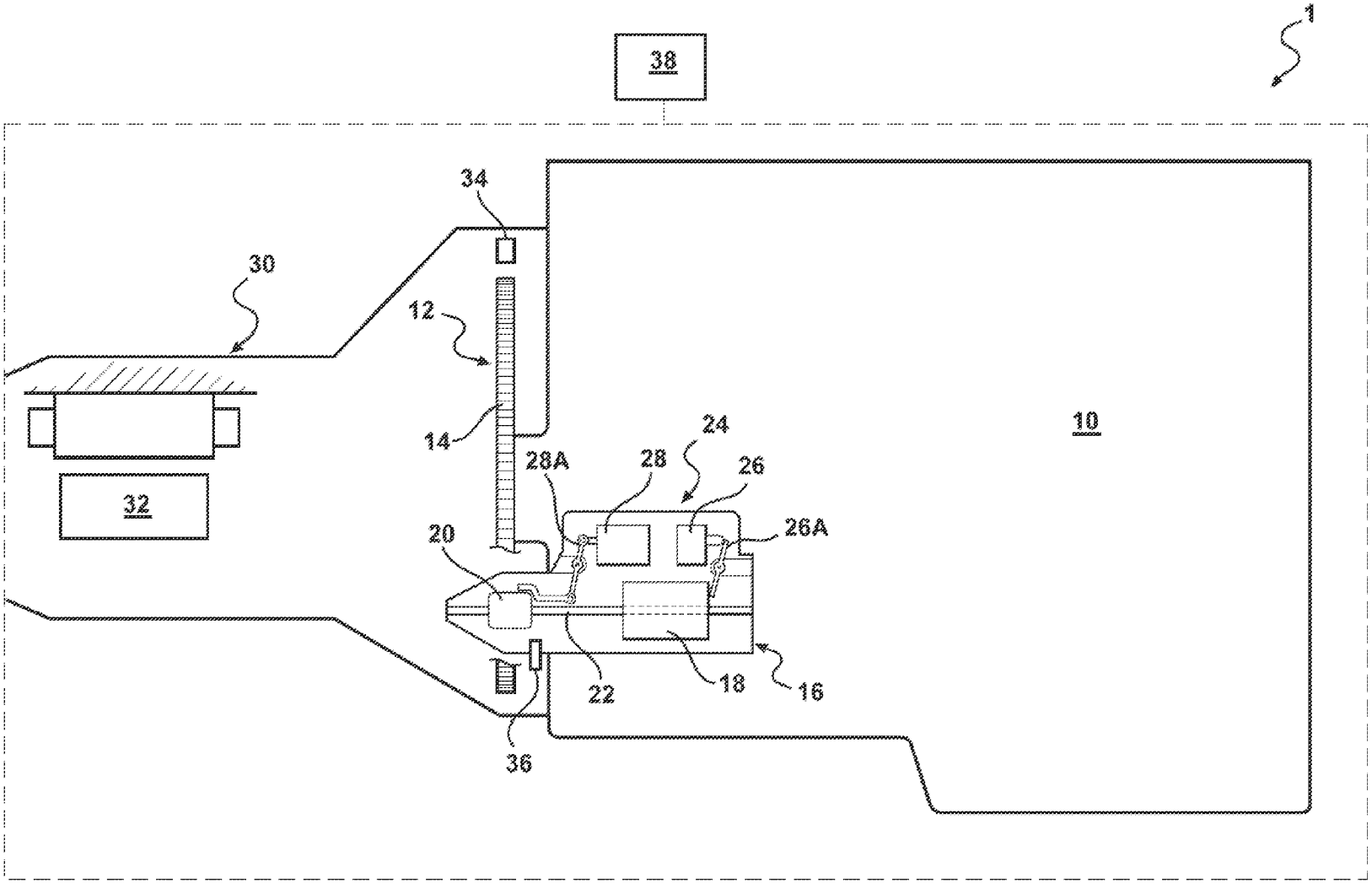
FIG. 1 is a schematic illustration of a motor vehicle powertrain including a starting system for an engine.

Referring to the drawings, wherein like reference numbers refer to like components, FIG. 1 shows a schematic view of a starting system 1 for a hybrid-electric vehicle powertrain. Starting system 1 includes an engine 10. Although starting system 1 is illustrated for a hybrid-electric vehicle powertrain, the system may be employed in any vehicle powertrain having engine 10.

Engine 10 includes a flywheel (or a flex-plate) 12 attached to a crankshaft (not shown) of the engine. Flywheel 12 is typically attached to the crankshaft via fasteners such as bolts or screws (not shown). A ring gear 14 having a specific gear tooth profile and spacing is arranged on the outer perimeter of the flywheel 12. Ring gear 14 typically has an outer diameter that is designed to facilitate effective starting of engine 10, as understood by those skilled in the art.

A pre-spun starter 16 is arranged relative to the engine 10 in close proximity to the ring gear 14 for starting the engine. The pre-spun starter 16 includes an electric motor 18. Electric motor 18 is employed to rotate a pinion gear 20 via a shaft 22. Pinion gear 20 includes a gear tooth profile and spacing that corresponds to that of the ring gear 14 for accurate meshing and engagement. Pre-spun starter 16 includes a pinion engagement solenoid assembly 24, which includes a motor solenoid 26 and a pinion-shift solenoid 28.

Electric motor 18 is activated by a motor solenoid 26 via a lever arrangement 26A in order to rotate the shaft 22, and spin pinion gear 20 up to a predetermined speed. After electric motor 18 is activated by the motor solenoid 26, a pinion-shift solenoid 28 pushes the pinion gear 20 out of the pinion gear resting position for engagement with the ring gear 14 via a lever arrangement 28A in order to start the engine 10. Once the engine 10 has been started, pinion gear 20 is typically disengaged from ring gear 14, and is retracted to its resting position.

The term "pre-spun", as employed to denote the starter 16, indicates a starter apparatus in which rotation of pinion gear 20 and engagement of the pinion gear with the engine ring gear 14 are controlled independently of each other. Such independent control is feasible because motor solenoids 26 and 28 are both distinct and separately controllable to perform the foregoing functions. Pinion gear 20 may, therefore, be pre-spun up to a predetermined speed prior to being pushed out for engagement with the ring gear 14.

Pre-spun starter 16 may be employed in any vehicle having an engine 10, but is especially beneficial in a vehicle which employs a start-stop system for the engine. As is known by those skilled in the art, a start-stop system is one where engine 10 is capable of being shut-off when engine power is not required, but which may also be immediately restarted when engine power is again called upon to propel the vehicle.

FIG. 1 additionally depicts a transmission 30 connected to engine 10 for transmitting engine power to drive wheels (not shown) of the subject vehicle. Transmission 30 also includes an appropriate gear-train arrangement, which is not shown, but the existence of which will be appreciated by those skilled in the art. Arranged inside transmission 30 is a motor-generator 32. Motor-generator 32 is employed to propel the subject vehicle either in concert with, or unaccompanied by engine 10. The engine 10 is capable of being shut-off, when the motor/generator 32 is running, such that the start-stop system may be employed even when the subject vehicle is on the move.

A first speed sensor 34 is arranged proximate to the flywheel 12 across from ring gear 14, such that the first sensor is able to sense rotational or angular speed (RPM) of the engine 10. Sensing of the rotational speed of engine 10 is preferably accomplished by registering the angular speed of a specially provided feature (not shown) on the ring gear 14, or registering angular speed of the actual ring gear teeth, as is known by those skilled in the art. A second speed sensor 36 is arranged proximate to pre-spun starter 16, across from any of the starter rotating components, such as a rotor of the electric motor 18, pinion gear 20, or shaft 22, in order that the second sensor is able to sense rotational speed of the starter. Each of the speed sensors, 34 and 36, may be configured either as an optical proximity sensor, or as a magnetic angular speed sensor, such as a Hall effect sensor, that varies its output voltage in response to changes in magnetic field, as understood by those skilled in the art.

A controller 38 is arranged on the vehicle relative to the vehicle powertrain, and configured to control the starting of engine 10, especially during the start-stop operation. Controller 38 is configured to regulate the rotational speed of the pre-spun starter 16 to substantially synchronize the rotational speed of the starter with the rotational speed of the engine 10, based on the parameters sensed by speed sensors 34 and 36. The regulation of the rotational speed of the pre-spun starter 16 may furthermore be based on a determination of whether the sensed speeds of the pre-spun starter and of the engine 10 are within a pre-determined speed difference. The pre-determined difference in speeds of the pre-spun starter 16 and of the engine 10 may be established via an empirical method or by design.

Accordingly, the synchronization of the rotational speeds of pre-spun starter 16 and engine 10 may be accomplished by the controller 38 if the sensed speeds of the pre-spun starter and of the engine are determined to be outside of the pre-determined speed difference. The regulation of the rotational speed of the pre-spun starter 16 is accomplished either before, or after the pinion gear 20 has been spun up by electric motor 18, but prior to the pinion gear being pushed out to engage and mesh with the ring gear 14. Such synchronization of the rotational speeds of pre-spun starter 16 and engine 10, results in reduced noise, vibration and harshness (NVH) during starting of the engine, if, following engine shut-off, the speed of the engine did not, for whatever reason, decrease to zero RPM.

Figure 2:
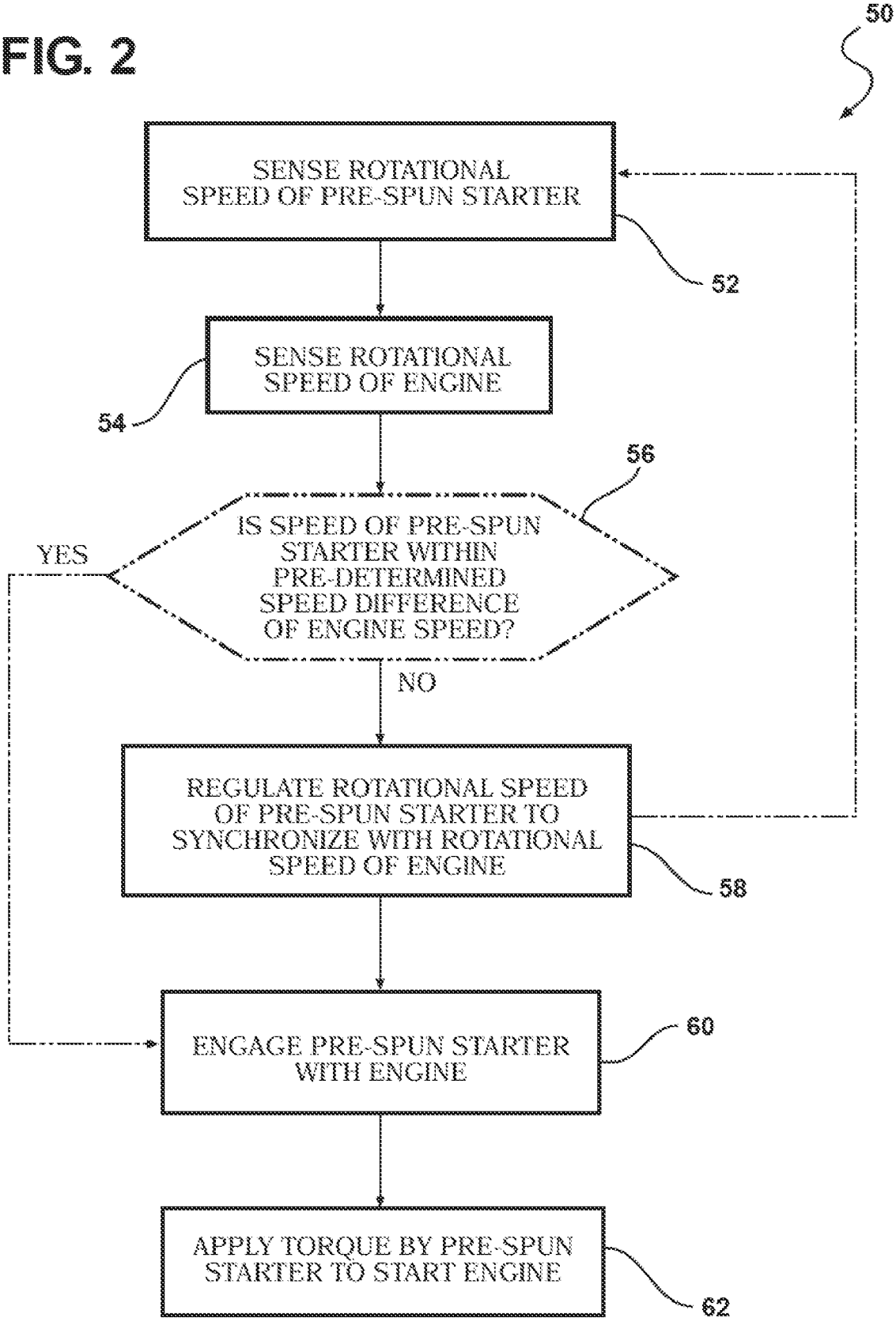
FIG. 2 is a flow chart illustrating a method for controlling the starting system depicted in FIG. 1.

FIG. 2 depicts a method 50 for controlling a starting system for an engine of a motor vehicle having a pre-spun starter 16 for selective meshing with, and starting of the engine 10. Although method 50 is described herein as employed to reduce NVH in a hybrid-electric vehicle of FIG. 1, it may similarly be employed in other types of vehicles utilizing engine 10.

The method commences in frame 52, where rotational speed of the pre-spun starter 16 is sensed. Following frame 52, the method proceeds to frame 54, where rotational speed of the engine 10 is sensed. After frame 54, according to the method 50, controller 38 may determine whether the sensed speeds of the pre-spun starter 16 and of the engine 10 are within a pre-determined speed difference (as described with respect to FIG. 1) in the optional frame 56. In such a situation, if in the optional frame 56 the sensed speeds of the pre-spun starter 16 and of the engine 10 have been determined to not be within the pre-determined speed difference, the method proceeds to frame 58.

In frame 58, the rotational speed of the pre-spun starter 16 is regulated by the controller 38 to substantially synchronize the rotational speeds of the pre-spun starter and of the engine 10. Following frame 58, the method loops back to frame 52, in order to perform operations in frames 52, 54, and 56, and confirm that the sensed speeds of the pre-spun starter 16 and of the engine 10 have been set within the pre-determined speed difference.

If in the optional frame 56, the sensed speeds of the pre-spun starter and of the engine are determined to be within the pre-determined speed difference, the method proceeds to frame 60. In frame 60, controller 38 controls pinion gear 20 to engage with ring gear 14, i.e., pre-spun starter 16 to engage with engine 10. After the engagement of the pre-spun starter 16 with the engine 10 is complete, the method proceeds to frame 62, where controller 38 controls pre-spun starter 16 to apply torque to the engine 10, such that the engine is started.

If, on the other hand, in the optional frame 56, the sensed speeds of the pre-spun starter and of the engine are determined to be within the pre-determined speed difference, the method proceeds directly to frame 60, and from there to frame 62 to start the engine 10 via the pre-spun starter 16.

The method 50 may also be performed without employing the feedback loop operation centered on frame 56. In such a situation, the method may proceed from frame 54 directly to frame 58, where the controller 38 may simply provide a signal to the electric motor 18 to substantially synchronize the rotational speed of the pre-spun starter 16 with that of the engine 10. In such a case, the synchronization of the pre-spun starter 16 and the engine 10 is accomplished via a control signal based on a determined difference, or delta in rotational speeds as sensed by the speed sensors 34 and 36. Following frame 58, the method proceeds to frame 60 to engage pre-spun starter 16 with engine 10, and from there to frame 62, to start the engine by applying torque via the pre-spun starter 16.

While the best modes for carrying out the invention have been described in detail, those familiar with the art to which this invention relates will recognize various alternative designs and embodiments for practicing the invention within the scope of the appended claims.

The invention claimed is:

1. A method for controlling a starting system for an engine of a motor vehicle having a pre-spun starter for selective meshing with and starting of the engine, and a controller for controlling the starting of the engine, the method comprising:

sensing of a rotational speed of the pre-spun starter;

sensing of a rotational speed of the engine;

determining whether the sensed speeds of the pre-spun starter and of the engine are within a pre-determined speed difference;

regulating the rotational speed of the pre-spun starter to substantially synchronize the rotational speed of the pre-spun starter with the rotational speed of the engine if the sensed speeds of the pre-spun starter and of the engine are not within the pre-determined speed difference;

engaging the pre-spun starter with the engine; and applying torque by the pre-spun starter to the engine for starting the engine.

2. The method of claim 1, wherein said sensing of the rotational speed of the pre-spun starter is accomplished via one of an optical speed sensor and a magnetic angular speed sensor.

3. The method of claim 2, wherein the magnetic angular speed sensor is a Hall effect type.

4. The method of claim 1, wherein said sensing of the rotational speed of the engine is accomplished via one of an optical speed sensor and a magnetic angular speed sensor.

5. The method of claim 4, wherein the magnetic angular speed sensor is a Hall effect type.

6. The method of claim 1, wherein said regulating the rotational speed of the pre-spun starter is accomplished by the controller.

7. The method of claim 1, wherein the vehicle is a hybrid-electric type vehicle having a motor/generator capable of propelling the vehicle, and the engine is capable of being shut-off when the motor/generator is running.

8. A system for controlling a starting of an engine of a motor vehicle, the system comprising:

a pre-spun starter having a gear for selective meshing with and starting of the engine;

a sensor configured to sense a rotational speed of the gear of the pre-spun starter;

a sensor configured to sense a rotational speed of the engine; and a controller configured to:

determine whether the sensed speeds of the pre-spun starter and of the engine are within a pre-determined speed difference;

regulate the rotational speed of the pre-spun starter gear to substantially synchronize the rotational speed of the gear of the pre-spun starter with the rotational speed of the engine if the sensed speeds of the pre-spun starter and of the engine are not within the pre-determined speed difference;

engage the pre-spun starter gear with the engine; and apply torque by the pre-spun starter gear to the engine for starting the engine.

9. The system of claim 8, wherein said sensing of the rotational speed of the pre-spun starter is accomplished via one of an optical speed sensor and a magnetic angular speed sensor.

10. The system of claim 9, wherein the magnetic angular speed sensor is a Hall effect type.

11. The system of claim 8, wherein said sensing of the rotational speed of the engine is accomplished via one of an optical speed sensor and a magnetic angular speed sensor.

12. The system of claim 11, wherein the magnetic angular speed sensor is a Hall effect type.

13. The system of claim 8, wherein the vehicle is a hybrid-electric type having a motor/generator capable of propelling the vehicle, and the engine is capable of being shut-off when the motor/generator is running.

14. A hybrid-electric vehicle having an engine and a motor/generator capable of propelling the vehicle, such that the engine is capable of being shut-off when the motor/generator is running, the vehicle comprising:

a first gear coupled to the engine;

a pre-spun starter having a second gear for selective meshing with the first gear in order to start the engine;

a sensor configured to sense a rotational speed of the first gear;

a sensor configured to sense a rotational speed of the second gear; and a controller configured to:

determine whether the sensed speeds of the first gear and the sensed speed of the second gear are within a pre-determined speed difference;

regulate the rotational speed of the second gear to substantially synchronize the rotational speed of the second gear with the rotational speed of the first gear if the sensed speeds of the pre-spun starter and of the engine are not within the pre-determined speed difference;

engage the second gear with the first gear; and apply torque by the pre-spun starter via the second gear to the first gear for starting the engine.

15. The vehicle of claim 14, wherein said sensing of the rotational speed of the pre-spun starter is accomplished via one of an optical speed sensor and a magnetic angular speed sensor.

16. The vehicle of claim 15, wherein the magnetic angular speed sensor is a Hall effect type.

17. The vehicle of claim 14, wherein said sensing of the rotational speed of the engine is accomplished via one of an optical speed sensor and a magnetic angular speed sensor.

18. The vehicle of claim 17, wherein the magnetic angular speed sensor is a Hall effect type.

* * * * *